United States Patent [19]

Smith et al.

[11] 4,050,379

[45] Sept. 27, 1977

[54] INKING APPARATUS

[75] Inventors: James H. Smith, Harford; Sherman S. Kumpf, Dryden, both of N.Y.

[73] Assignee: NCR Corporation, Dayton, Ohio

[21] Appl. No.: 687,288

[22] Filed: May 17, 1976

[51] Int. Cl.[2] ..... B41F 1/40

[52] U.S. Cl. ..... 101/327; 101/298

[58] Field of Search ..... 101/327, 324, 368, 125, 101/363, 335; 197/150, 1; 101/287, 288, 292, 297, 298, 299, 301, 316, 318

[56] References Cited

U.S. PATENT DOCUMENTS

| | | | |
|---|---|---|---|
| 970,295 | 9/1910 | Beard | 197/35 |
| 1,073,340 | 9/1913 | Furman | 101/327 |
| 2,316,040 | 4/1943 | Wirfel | 101/327 |
| 2,414,895 | 1/1947 | Reynolds | 101/327 X |
| 2,857,839 | 10/1958 | Jamieson | 101/327 X |
| 3,146,703 | 9/1964 | Mason et al. | 101/125 |
| 3,218,967 | 11/1965 | Childress | 197/150 X |
| 3,376,812 | 4/1968 | Sterling | 101/327 X |
| 3,572,243 | 3/1971 | Gronau | 101/327 |
| 3,885,495 | 5/1975 | Funahashi | 101/327 |

*Primary Examiner*—J. Reed Fisher

*Attorney, Agent, or Firm*—J. T. Cavender; Wilbert Hawk, Jr.; George J. Muckenthaler

[57] ABSTRACT

An inking device for record media includes a self-contained ink reservoir bordered by a holder portion as one wall of the reservoir, and a backing plate as another wall adjacent a porous rubber electro pad. The backing plate includes a plurality of chamfered apertures therethrough which are circumscribed by a like number of slotted tubes which tubes separate the backing plate and the holder portion. A steel ball is positioned within each tube and controls the flow of ink from the ink reservoir to the electro pad by reason of swinging movement of the device wherein the ball is unseated from the chamfered aperture in the downward direction of movement upon the electro pad striking the record media to permit flow of ink to the pad, and the ball is reseated on the aperture during return movement of the device to stop the flow of ink to the pad. A low hydraulic pressure occurs during the striking action to unseat the ball and a suction occurs on the return movement to reseat the ball.

3 Claims, 8 Drawing Figures

INKING APPARATUS

BACKGROUND OF THE INVENTION

In the printing field, there have been numerous ways and means for impressing a mark or indicia on record media, one common means being the use of a rubber or like porous stamp or pad which carries a limited supply of ink therein for making at least one and perhaps another impression. As improvements in porous material were made available, the ink pad was able to retain sufficient ink therein for repeated impressions without re-inking the pad. More recently, there have been provided devices associated with the stamp or pad which tend to supply the pad with the proper amount of ink or to maintain sufficient ink within the pad or stamp for such repeated impressions.

In modern business machines, the number of required impressions is, of course, greatly increased by the volume of documents or like record media which must be processed in day-to-day operations. In order to supply a quantity of ink to the impression stamp or pad and to control the flow of ink to the pad, it is a basic requirement that sufficient ink be permitted to flow to the pad so as to each time have a legible mark on the record media, and that precautions be taken to prevent an over supply of ink to flow to the pad which would result in smudging of the mark or indicia.

In regard to means for controlling the flow of ink to a printing member and/or to a printing surface, representative ways and means are disclosed in prior art relevant to the present invention. One example is British Patent No. 1,241,794, inventor H. F. Farrow, which shows printing apparatus having a piston, a cylinder carrying a hollow piston connected with the cylinder through one opening and connected with a chamber through other openings. The first-mentioned piston has a ball valve biased by a spring to a position in which it closes one passage to the chamber and also prevents passage of ink between the chamber and its outlet. Operation of the pistons causes closing of certain ports and opening of the outlet to allow ink to flow to the printing surface, and when sufficient ink has been supplied, the pressure in the chamber increases and the ball valve is lifted from its seat to allow excess ink to return to the supply through one passage to the chamber. As pressure is released, the hollow piston is moved so that the outlet is closed by the ball valve. Further reduction of pressure moves the first-mentioned piston to open the chamber inlet ports and ink flows from the supply to the chamber for the next operation.

U.S. Pat. No. 1,343,633, issued to S. G. McPheters, discloses an automatic marking or stamping device having a head, a wick-receiving chamber, and a wick communicating with a chamber connected with a fluid tank through a supply pipe. A valve cooperates with a valve seat in the pipe and has a stem connected with a bridge-piece adjacent the chamber, the valve being loaded on the seat by a spring. Pressure on the face of the head unseats the valve and allows fluid to flow from the pipe to the head and through the various apertures for making a mark.

U.S. Pat. No. 3,072,053, issued to G. Becker et al., shows an inking device for inking ribbons, felt rollers, and rubber coatings, and has an inking roller covered with felt or porous rubber material which becomes impregnated by ink entering through bores into several grooves. Another inking roller has a closure valve comprising a ball and a spring for convenient filling of the roller.

U.S. Pat. No. 3,376,812, issued to R. E. Sterling, discloses a reciprocal porous printing member with ink reservoir feed wherein a reservoir is connected with a solenoid to be moved thereby along with a porous printing member, while a U-shaped member is secured to a frame to remain fixed. The reciprocating motion of the reservoir between a non-printing and a printing position is used to transfer and to seal off the ink supply in the reservoir to the porous printing member. A portion of the reservoir has an area with spaced apertures for ink flow to the porous printing member. A second porous member attached to the U-shaped member covers the spaced apertures and, in the non-printing position, certain areas of the U-shapedmember press on the second porous member and block the flow of ink. When the solenoid is energized, the reservoir is pushed towards the paper on the platen and away from the U-shaped member, and the second porous member soaks up the ink in the areas adjacent the spaced apertures. A spring restores the solenoid and the reservoir towards the U-shaped member, and the second porous member contacts the areas to compress the porous member to seal off the flow of ink to the spaced apertures.

And, U.S. Pat. No. 3,536,007, issued to A. J. Harvey, discloses a self-inking laminated die plate having resilient mats separating an upper plate and a base, the plate having a supply line from a reservoir to an ink cavity, the supply line including a one-way check valve permitting ink flow to the cavity. A second one-way check valve is in a line from the cavity to a second reservoir to allow fluid flow to the cavity. A die plate is located adjacent the article to be printed and rests on an apertured platform whereby pressure exerted by the article on the plate causes the plate to yield and decreases the volume of ink in the cavity. The ink flows through the apertures in the platform and through the lines in the die plate. When the pressure is relieved, the volume of the cavity increases and ink flows through the lines to the cavity.

SUMMARY OF THE INVENTION

The present invention relates to inking apparatus and more particularly to a self-contained inking member or electro which includes an electro holder as one wall of an ink reservoir, and a backing plate as another wall of the reservoir and adjacent the inking pad. The backing plate also provides a support for the resilient, porous electro, and the electro holder is spaced from the backing plate to provide the ink reservoir therebetween. A plurality of slotted tubes separate and space the electro holder and the backing plate, the plate having a chamfered aperture for each tube and a steel ball fitting within the tube and seated on the aperture.

When the electro pad is caused to be moved downwardly onto the record media in a printing or indicia-applying operation, a low hydraulic pressure is initiated from the plane of impact and thence through the resilient pad which pressure causes the steel balls to be lifted off the chamfers of the apertures and ink is allowed to flow from the reservoir to the backside of the pad. As the pad is raised from the record media, a suction is developed through the resilient pad and thereby draws the ink from the backside of the pad into and through the porous rubber portion thereof and the balls are again seated, by reason of gravity, in the chamfers of the apertures to prevent ink flow from the reservoir to the pad. Movement of the electro pad and its associated apparatus is by means of a solenoid and a return spring for swingably moving the device from a non-printing to a printing position and return to the non-printing position.

In view of the above discussion, the principal object of the present invention is to provide an improved inking device.

An additional object of the present invention is to provide a self-contained inking device for improved utility and longer life.

Another object of the present invention is to provide an inking device which permits flow of ink to the inking pad in controlled manner.

A further object of the present invention is to provide inking apparatus which is movable from a non-printing to a printing position and return, and wherein a supply of ink is permitted to flow from a reservoir to the inking pad upon movement of the apparatus to the printing position, and wherein the supply of ink is closed off upon movement of the apparatus to the non-printing position.

Additional advantages and features of the present invention will become apparent and fully understood from a reading of the following description taken together with the annexed drawing, in which.

Figure 1:
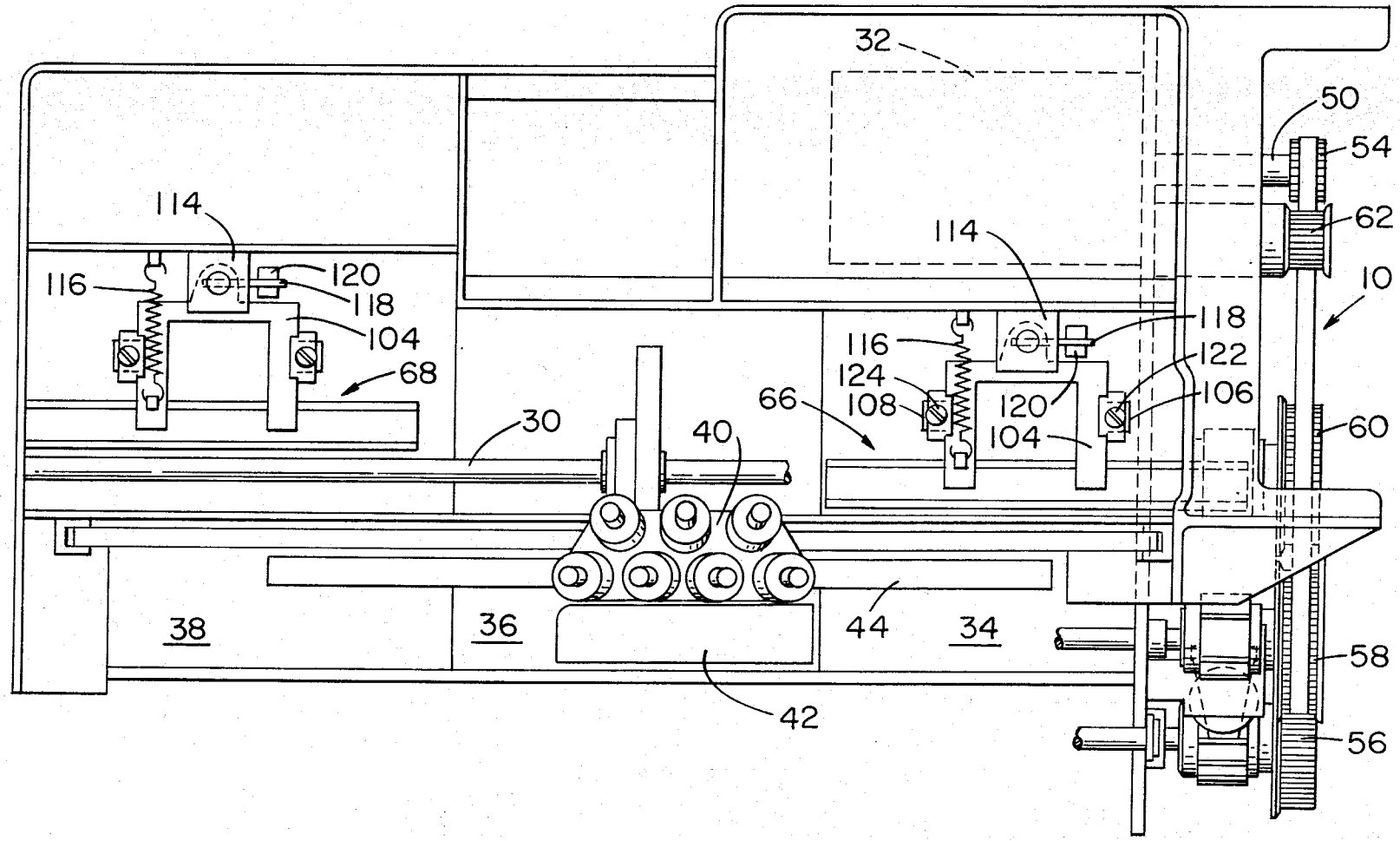
FIG. 1 is a plan view of a printer incorporating the subject matter of the present invention.
Figure 2:
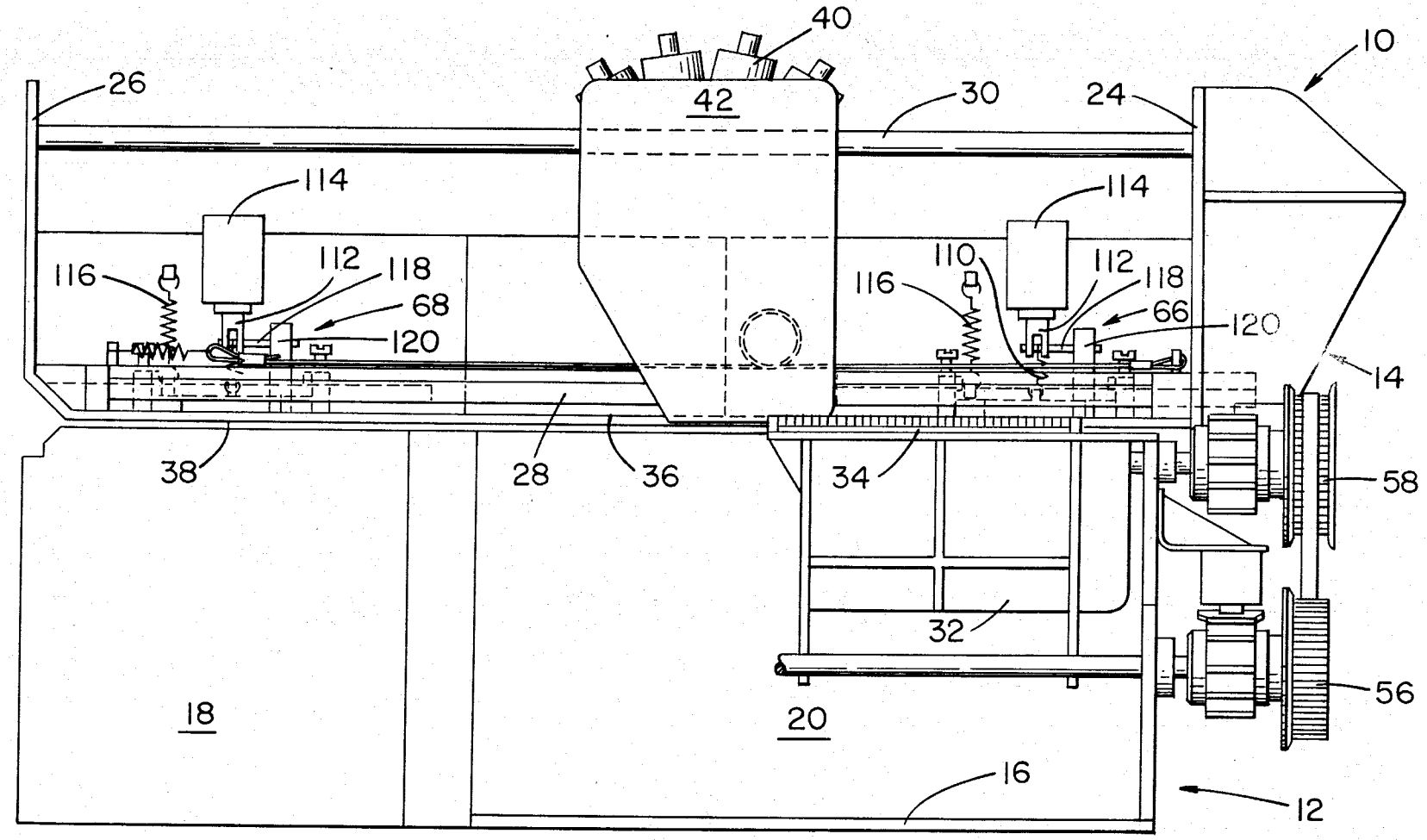
FIG. 2 is a front elevational view of the printer shown in FIG. 1.

Referring now to FIGS. 1 and 2 of the drawing, there is shown printer structure of limited illustration wherein a business machine designated generally as 10 has lower and upper portions 12 and 14, respectively, the lower portion including a supporting base 16 and enclosure panels 18 and 20 for containing various machine elements not a part of the present invention. The upper portion 14 of the machine includes side walls 24 and 26 connected by suitable rods or rail members, there being a pair of rods or shafts 28 and 30, for a purpose to be later described, along with additional connecting frame members for carrying the printing mechanism.

A prime mover, which may be in the form of a continuous-run motor 32, is located at the right, lower rear area of machine lower portion 12 and such motor supplies energy for the various operating members of the machine, one of which is printing mechanism which is made to travel in a side-to-side direction for effecting the printing operation.

Although the printing mechanism may be one of several types, the present structure is directed to a design which includes matrix type printing mechanism positioned in a generally upright manner and carried or driven back and forth across the machine. The printing mechanism may comprise one or more print heads for operating at one or more print stations. In a business machine of the printer type with which the present invention may be particularly useful, a plurality of such print stations may be appropriately named a receipt station 34, a journal station 36, and a slip or form station 38. Inasmuch as the present invention is directed to inking apparatus, the receipt station 34 and the slip or form station 38 are most applicable here by reason of the mark or indicia made on the receipt paper or on the slip or form inserted into the machine. Additionally, although a single print head 40 may suffice to effect the several printing operations, a plurality of such print heads may be utilized for faster and more precise operations. Forward of the print head 40 and connected thereto to be carried thereby may be a ribbon cassette 42, the structure and function of which is not directly related to the present invention and therefor will not be described in detail.

Figure 3:
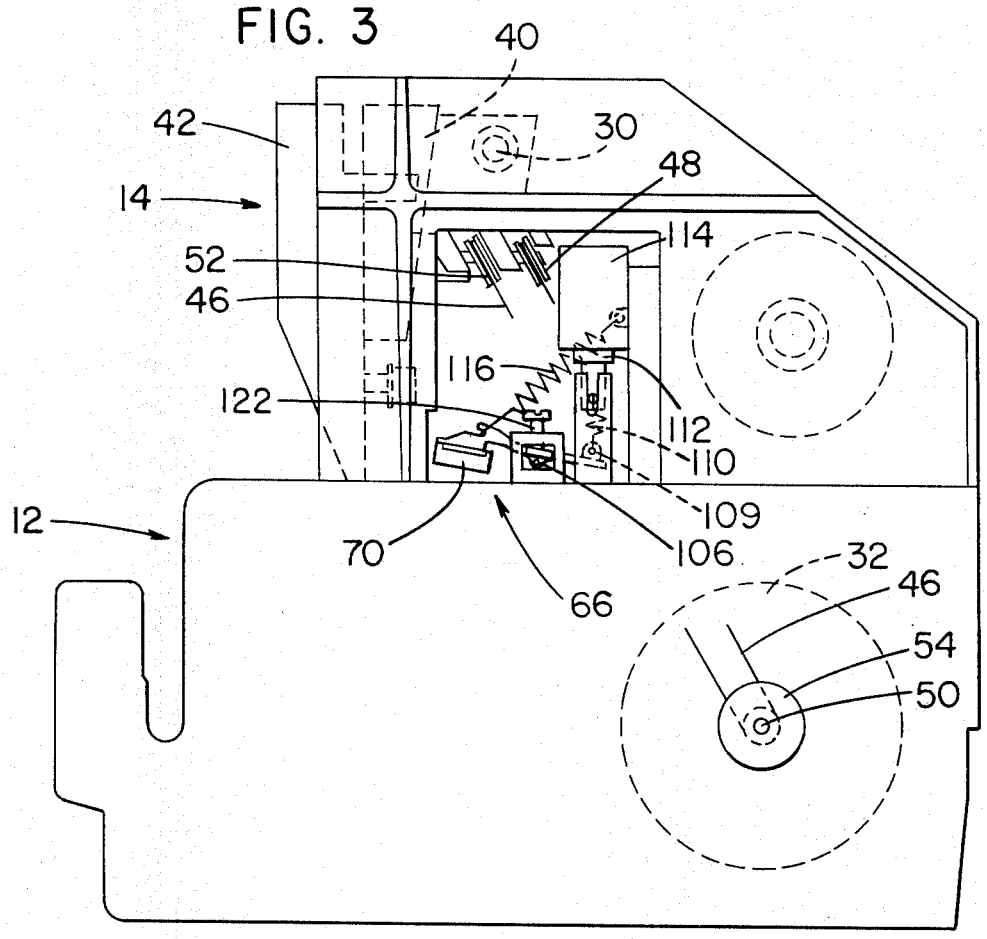
FIG. 3 is a side elevational view of the printer shown in FIG. 2.

The print head 40 and the cassette 42 may be moved in such back and forth motion, and operable with a printing platen 44, by means of a cable or cord 46, FIG. 3, one end thereof being securely connected to an attaching point on the rear of the print head 40, the cable extending leftwardly toward and around an appropriate pulley (not shown) journaled at the left side frame 26, and returning in a path rightward and rearward of the print head 40, toward and around a pulley 48, thence downwardly toward and around a helical-type gear on the shaft 50 of the motor 32, upward toward and around a pulley 52, and leftward toward the print head 40, there being an appropriate spring connected in the drive path of the cord to provide proper tension therein. By appropriate control mechanism, the motor 32 drives, by means of the cable 46 and the various pulleys, the print head 40 and the cassette 42 in the desired side-to-side motion for printing. The shafts 28 and 30 provide guide means to carry the print head 40 and the cassette 42 in a precise path for operation with the platen 44 as the print head is caused to be driven by the cable 46 in back and forth travel.

As seen in FIGS. 1 and 2, the drive for the various machine parts is taken off the motor shaft 50 which has a pulley 54 secured thereto, there being in the drive line a timing pulley (not shown), a journal feed pulley 56, a receipt drive pulley 58, a slip drive pulley 60, and an idler pulley 62. While these drive portions of the machine are not directly related to the invention, a more complete description and showing of the various drives can be had from application Ser. No. 665,036, filed Mar. 8, 1976 and assigned to the same assignee as the present invention.

Referring again to FIGS. 1 and 2, and observing that the receipt print station 34 is at the right of the machine, the journal print station 36 is located in the middle portion of the machine, and the slip or form print station 38 is at the left of the machine, indicia or marking means is provided at the recepit station 34 and at the form or slip station 38 for stamping a mark or indicia on the receipt paper and on the slip or form during operation of the machine. Such mark or indicia means is commonly referred to as an electro or inking pad which has as its basic component a porous member carried by appropriate supporting mechanism for desired operation.

Figure 4:
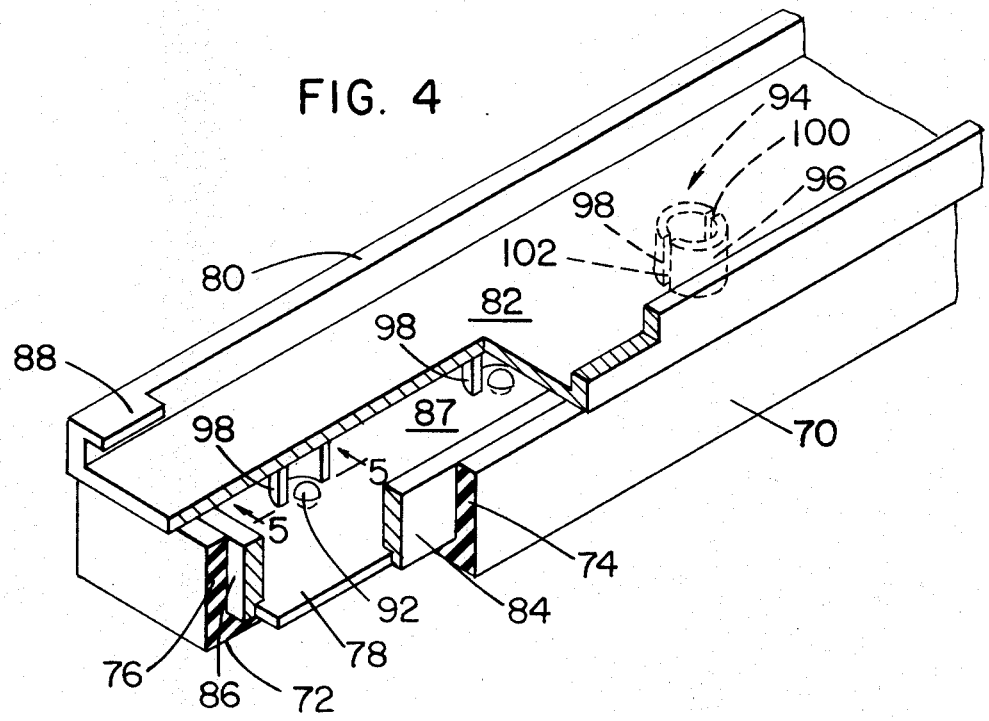
FIG. 4 is an enlarged perspective view partially in section of the inking device of the present invention.
Figure 5:
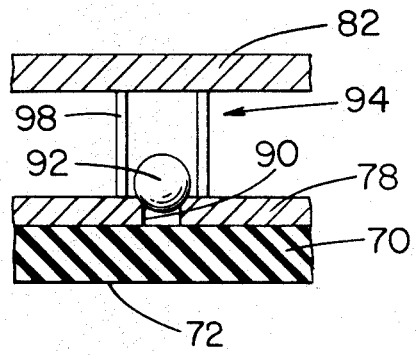
FIG. 5 is an enlarged view, partly in section, of the ink control device taken on the plane 5—5 of FIG. 4.

The electro or inking device of the present invention, generally indicated as 66 for the receipt station and as 68 for the slip or form station, comprises a porous rubber electro pad 70 FIGS. 4 and 5, which includes a face portion 72 and upstanding wall portions 74 and 76 to create a hollow container-like member, it being understood, of course, that there are two of the portions 74 and two of the portions 76 to form a troughlike member. While not shown, it is, of course, understood that the face of the porous pad contains raised portions for applying a mark or indicia on paper or like record media as such face portions come in contact therewith. A plate member 78 is fitted inside the walls 74 and 76 of the electro pad 70 and a plastic electro pad holder 80 includes a top or cover portion 82 and wall portions 84 and 86 extending downwardly therefrom, again the wall portions 84 and 86 being formed to provide an enclosure of rectangular shape. The plate member 78 is bonded to the holder 80 wall portions 84 and 86 and the electro pad 70 is also bonded to the pad holder 80 to provide an enclosed reservoir or cavity 87 for containment of ink, such ink being the supply for the porous pad 70. The electro holder 80 is formed or shaped with ears 88 at the four corners thereof to be supported from an appropriate operating member, as shown in FIGS. 6 and 7.

The plate member 78, FIGS. 4 and 5, serves as a backup element for the electro pad 70 by providing a rigid plane on the back side of the pad to give the pad support as the mark or indicia portions on the face of the electro pad are operated to make a mark or printlike impression. Such plate member 78 includes three spaced apertures 90 therethrough, each of such apertures having a chamfer on the top side of the plate member 78 for reception of a steel ball 92 to seat thereon in a manner to provide valve or metering means of the ink from the cavity 87 to the porous pad 70. Associated with each of the chamfered apertures 90 and the steel balls 92 is a perforated ball container 94, herein shown as a tube or cylindrical-like member comprising arcuate portions 96 and 98 formed by cutting the tube in a lengthwise manner and thereby providing a pair of slots 100 and 102 in the tube 94 for passage of ink from the cavity 87 into the tube 94 and through the aperture 90 to the upper or back portion of the porous pad 70. Of course, such ball container may have form and shape, other than tube-like, to enable flow of ink from the cavity 87 and controlled by the ball 92 to the porous pad 70.

Figure 6:
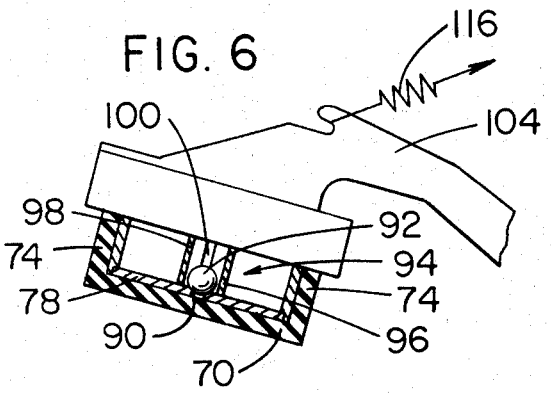
FIG. 6 is a view of the electro device shown in the return or non-printing position.
Figure 7:
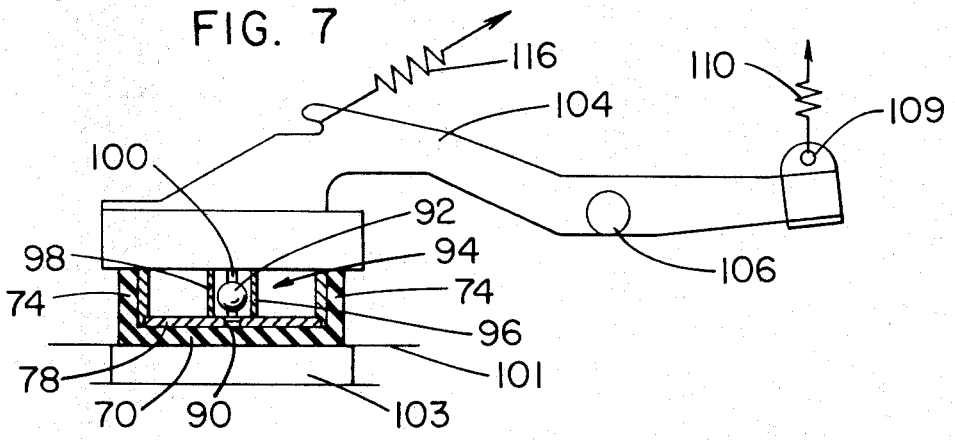
FIG. 7 is a view of the electro device shown in an impact or printing position.

The two extreme positions of the inking apparatus, FIG. 6 showing the porous pad 70 supported in an idle or non-printing or non-marking position, and FIG. 7 showing the pad 70 in a printing or marking position for marking on paper or other record material 101 placed on a machine platen surface 103, are made possible by means of a U-shaped drive arm 104, see also FIG. 1, carried and supported at pivots 106 and 108, the pivots acting as a fulcrum for the arm 104. An aperture or abutment 109 at the rear end of the arm 104 provides a point of attachment for a spring 110 (FIGS. 2 and 3) connected to the armature 112 of a solenoid 114 supported from the frame of the machine. A spring 116 is connected to the arm 104 at a location above the electro pad 70 and to the machine frame to return the pad to the non-operating or non-marking position. A pin 118 is connected with the plunger 112 and with a guide member 120 for the purpose of providing a positive connection between the plunger 112, the spring 110 and the attachment point 109 in the arm 104. A pair of adjustment screws 122 and 124 are positioned at the pivots 106 and 108 of the U-shaped arm 104 to provide for change in quality of the mark or indicia on the paper. Additionally the strength of the tension spring 110 and the position of the solenoid 114 may closely control the stroke of the solenoid plunger 112 to adjust the forces necessary to cause the electro pad to be swung into contact with the record material.

Figure 8:
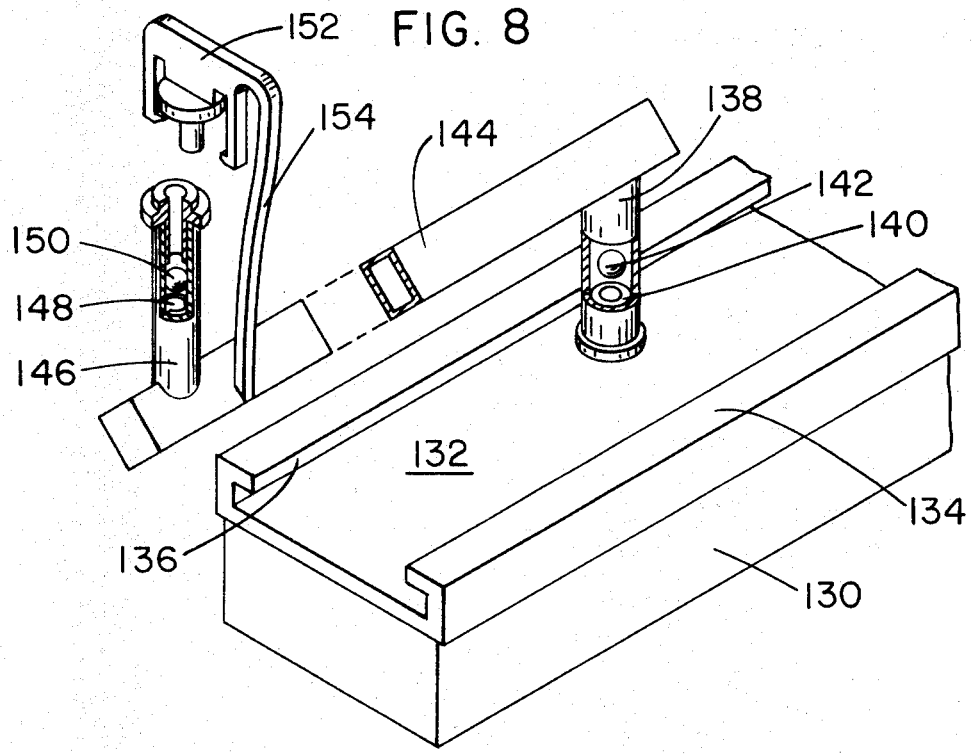
FIG. 8 is a perspective view of a modification of the inking device of the present invention.

A modification of the invention is shown in FIG. 8 wherein the electro pad 130 is of similar construction as pad 70, however, the electro holder 132 is of a slightly different shape for providing support of the holder and pad, the holder having rails 134 and 136 along the length thereof. A tubular member 138 is secured to the electro holder 132, such member including a sleeve or apertured portion 140, chamfered to receive a steel ball 142 to meter ink from a supply member or reservoir 144. The reservoir 144 also includes a fill tube 146, similar as tube 142, and having a sleeve or apertured portion 148, chamfered to receive a steel ball 150 to meter the ink flowing through the tube 146 to the reservoir 144. A closure member 152 carried on a flexible leg 154 is made to fit the upper opening of tube 146.

In the operation of the inking apparatus, an inkfilled electro 70 together with its holder 80 is slidingly placed into position to be received by the drive arm 104 at the receipt station 34, and, if desired, one at the form or slip station 38. At this time, the arm 104 is holding the electro pad in a raised position (FIG. 6) and, by reason of the force of gravity, the steel ball 92 is seated on the aperture 90 thereby preventing any flow of ink from the reservoir 87 to the electro pad 70. When it is required that the electro be used to place a mark or imprint, such as "Your Receipt, Mar. 31, 1976" or any other notation, on the paper 101, the solenoid is energized by appropriate circuitry and the plunger 112 is caused to be moved upwardly (FIGS. 2 and 3), thereby pulling on the spring 110 to rotate the U-shaped drive arm 104, which carries the electro pad, and move the pad in swinging manner about the pivots 106 and 108 to impact on the paper 101 across the machine platen portion 103 (FIG. 7). The downward action of the electro 70, during the time of printing or marking and the resulting striking or impact on the paper 101, initiates a low pressure through compression of the porous material of the electro 70, such pressure moving upwardly through the apertures 90 in the plate 78 and lifting the steel balls 92 off the chamfer or seat of the aperture 90 to thereby allow ink to flow from the reservoir or cavity 87 through the slots 100 and 192, down through the apertures 90 and onto the upper or back side of the electro pad 70 for replenishing thereof. The differences in the specific gravity of the steel ball and of the ink, along with a certain range of ink viscosity, allow the ink to flow from the reservoir 87 to the porous pad 70 while the ball 92 is suspended in the ink in the container 94.

When the solenoid 114 is deenergized, the plunger 112 moves downward and the spring 116 returns the electro 70 upwardly to the home or non-printing position, the initial lifting of the electro 70 off the paper 101 causing a slight suction downwardly to draw ink from the back side of the electro 70 through the porous material and to the printing side for replenishing thereof. As the electro 70 is caused to be swung to the home position, the steel balls 90 are again seated on the chamfered apertures to seal off the flow of ink from the reservoir 87 to the porous electro 70.

The slotted tubes 94, in addition to separating or spacing the electro holder 80 and the plate 78, are sized in relation to the diameter of the steel ball 92 to insure proper guiding of the steel ball in its up and down travel and proper seating of the ball on the chamfered aperture 90 of the metal plate 78, and the slots 100 and 102, and in addition to providing a passageway from the reservoir 87 to the aperture 90, also insure that the steel ball 92 does not freeze or stick to the walls of the tube 94. The steel ball 92 is the only moving part within the reservoir 87 and moves only when the electro pad 70 is swingably moved from one to another position and then returned.

A variation or modification in the present invention may include magnetizing the metal back-up plate 78 or the steel balls 92 as a means of controlling ink flow from the reservoir 87 to the electro pad 70. Additional changes in the viscosity of the ink or changing the number and/or size of the apertures 90 in the plate 78 can result in optimum life of the electro pad 70 and the printing or impression made on the record material 101.

It is thus seen that herein shown and described is an inking apparatus for making a mark or imprint on record media wherein a steel ball is caused to be moved up and down inside a tubular member in response to swinging movement of the porous pad, the ball effectively permitting flow of ink from the reservoir to the porous pad in one position of the pad, and closing off the flow of ink in the other position of the pad. The apparatus enables the accomplishment of the objects and advantages mentioned above, and while two embodiments of the invention have been disclosed herein, variations thereof may occur to those skilled in the art. It is contemplated that all such variations, not departing from the spirit and scope of the invention hereof, are to be construed in accordance with the following claims.

What is claimed is:

1. An inking device operable between first and second positions comprising an elongated porous printing member having a printing surface thereon, a backing plate member having a plurality of spaced apertures therein and in contact with said porous printing member and distal from said printing surface, means supporting said porous printing member for operation between said first and second positions, said backing member and said supporting means defining an ink reservoir therebetween, and means including a cylindrical member defining lengthwise slots therein for flow of ink from said reservoir into said cylindrical member and associated with each of said apertures and spacing said plate member and said supporting means, and a circular member positioned in each of the cylindrical members and operable in relation to a respective aperture for metering ink from said reservoir to said porous printing member upon movement of said inking device from the first to the second position.

2. In a printer having inking apparatus and solenoid means for swingably moving said apparatus from a non-inking to an inking position, an elongated porous member having an inking surface thereon, a plate member having a plurality of spaced apertures therein and in contact with said porous member and distal from said inking surface, cover means for holding said porous member and said plate member in contained manner, said cover means and said plate member defining an ink reservoir therebetween, and means including a plurality of tubular members each defining lengthwise opposed slots therein for flow of ink from said reservoir into said tubular memeber, each of said tubular members surrounding an aperture and spacing said plate member and said cover means, and a ball member positioned in and guided by each of the tubular members and operable in relation to a respective aperture for metering ink from said reservoir to said porous member through said apertures upon swinging movement of said inking apparatus from the non-inking to the inking position.

3. A method of metering ink from a reservoir to a juxtaposed porous inking member comprising the steps of:

placing an apertured plate member in contact with the back side of said porous member;

providing a plurality of slotted tubular members in spaced relationship and surrounding the apertures in said plate member wherein one end of said tubular members is operably associated with the respective apertures;

placing a plurality of ball members in said tubular members to be guided therein for operating to open and close said apertures placing a cover across the other end of said tubular members wherein said tubular members space said plate member and said cover to form said reservoir; and providing solenoid actuating means to swing said inking member and said reservoir from a non-inking position to an inking position whereupon said ball members are caused to be lifted from the apertures in said plate member to allow ink to flow from said reservoir through said tubular members and through the apertures to said porous member, and to swing said inking member and said reservoir from an inking position to the non-inking position whereupon said ball members are caused to be seated on said apertures in said plate member to stop the flow of ink from said reservoir to said porous member and to draw the ink through said porous member to the inking face thereof.

* * * * *